US008857676B1

(12) United States Patent
Navarro

(10) Patent No.: US 8,857,676 B1
(45) Date of Patent: Oct. 14, 2014

(54) HAT INSERT DEVICE

(71) Applicant: Jose Navarro, Santa Clarita, CA (US)

(72) Inventor: Jose Navarro, Santa Clarita, CA (US)

( * ) Notice: Subject to any disclaimer, the term of this patent is extended or adjusted under 35 U.S.C. 154(b) by 0 days.

(21) Appl. No.: 13/772,367

(22) Filed: Feb. 21, 2013

Related U.S. Application Data

(60) Provisional application No. 61/610,490, filed on Mar. 14, 2012.

(51) Int. Cl.

| | |
|---|---|
| ***A41B 1/02*** | (2006.01) |
| ***A47G 25/00*** | (2006.01) |
| *D06C 5/00* | (2006.01) |
| *A42C 5/00* | (2006.01) |

(52) U.S. Cl.
CPC ..... *A47G 25/00* (2013.01)
USPC ..... 223/84; 2/175.4

(58) Field of Classification Search
USPC ..... 223/84; 2/175.4, 195.5, 410, 414, 425; D2/891, 892, 894; D29/122
See application file for complete search history.

(56) References Cited

U.S. PATENT DOCUMENTS

| | | | | | |
|---|---|---|---|---|---|
| 2,178,860 | A | * | 11/1939 | Knibloe | 2/181.4 |
| 2,505,403 | A | * | 4/1950 | Martin | 2/175.4 |
| 2,651,045 | A | * | 9/1953 | Shenkman | 2/175.4 |
| 2,740,567 | A | * | 4/1956 | Kaufman | 223/84 |
| 4,790,034 | A | | 12/1988 | Pass | |
| 5,481,760 | A | * | 1/1996 | Wood, Jr. | 2/195.5 |
| 5,884,335 | A | | 3/1999 | Whittaker | |
| 5,987,649 | A | | 11/1999 | Robertson | |
| D640,422 | S | * | 6/2011 | Green et al. | D29/122 |
| 7,958,570 | B1 | * | 6/2011 | Mooney | 2/195.5 |
| 7,966,673 | B1 | * | 6/2011 | Gibson | 2/425 |

* cited by examiner

*Primary Examiner* — Ismael Izaguirre
(74) *Attorney, Agent, or Firm* — Emery L. Tracy; Ruth Eure

(57) ABSTRACT

A hat insert device for maintaining a hat in a desired condition is provided. The hat has an inner flap along an opening of the hat. The hat insert device comprises a flat, planar insert having a first side, a second side substantially opposite the first side, a top edge, a bottom edge substantially opposite the top edge, a first edge between the top edge and the bottom edge, and a second edge substantially opposite the first edge. A retaining mechanism is formed in either the top edge of the insert or the bottom edge of the insert for maintaining the insert in a desired position. Upon positioning the insert inside the inner flap at the front of the hat, the insert provides support, stiffness, and structure in the hat.

11 Claims, 1 Drawing Sheet

10
12

BOTTOM VIEW 10
12
FLAP TO LOCK PLASTIC INSERT
13
FLEXIBLE PLASTIC INSERT 14

10
12
14
28
30

10
12
20
22
24
26
28
13
14

HAT INSERT DEVICE

The present application claims the benefit of priority of pending provisional patent application Ser. No. 61/610,490, filed on Mar. 14, 2012, entitled "Hat Stand".

BACKGROUND OF THE INVENTION

1. Field of the Invention

This invention relates generally to a hat insert device and, more particularly, the invention relates to a hat insert device provides a flexible plastic insert that, when placed inside the front of a ball cap, provides support, stiffness, and structure, keeping the cap looking fresh and new.

2. Description of the Prior Art

Over the last thirty or forty years, ball caps have become the standard head-gear for American men from golfers and baseball players to basketball players, NASCAR drivers and fans, hip-hop stars and fans, hikers, campers, movie stars, carpenters. Women, too, have taken up the ball cap as their own. Now as comfortable and stylish as a ball cap might be, over time, with wear and washings, a ball cap loses its new appearance when the peak becomes soft and fatigued, loses its initial height and stiffness.

SUMMARY

The present invention is a hat insert device for maintaining a hat in a desired condition. The hat has an inner flap along an opening of the hat. The hat insert device comprises a flat, planar insert having a first side, a second side substantially opposite the first side, a top edge, a bottom edge substantially opposite the top edge, a first edge between the top edge and the bottom edge, and a second edge substantially opposite the first edge. Retaining means is formed in either the top edge of the insert or the bottom edge of the insert for maintaining the insert in a desired position. Upon positioning the insert inside the inner flap at the front of the hat, the insert provides support, stiffness, and structure to the hat.

In addition, the present invention is a hat insert device for maintaining a hat in a desired condition. The hat has an inner flap along an opening of the hat. The hat insert device comprises a flat, planar insert haying a first side, a second side substantially opposite the first side, a top edge, a bottom edge substantially opposite the top edge, a first edge between the top edge and the bottom edge, and a second edge substantially opposite the first edge. A first retaining means is formed in the top edge of the insert for maintaining the insert in a desired position and a second retaining means is formed in the bottom edge of the insert for maintaining the insert in the desired position. Upon positioning the insert inside the inner flap at the front of the hat, the insert provides support, stiffness, and structure to the hat.

The present invention further includes a maintaining a hat in a desired condition. The hat has an inner flap along an opening of the hat. The method comprises providing a flat, planar insert having a first side, a second side substantially opposite the first side, a top edge, a bottom edge substantially opposite the top edge, a first edge between the top edge and the bottom edge, and a second edge substantially opposite the first edge, forming at least one V-cut notch in the top edge of the insert, forming at least one V-cut notch in the bottom edge of the insert, positioning the insert inside the inner flap at a front of the hat, maintaining the insert in a desired position, and providing support, stiffness, and structure to the hat.

DETAILED DESCRIPTION OF THE PREFERRED EMBODIMENTS

Figure 1:
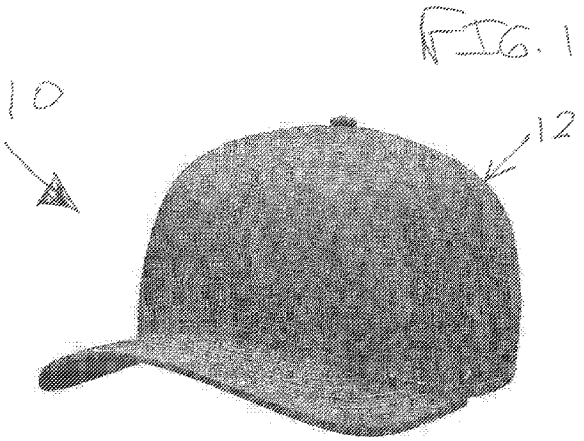
FIG. 1 is a top perspective view illustrating a hat insert device, constructed in accordance with the present invention, inserted within a hat.
Figure 2:
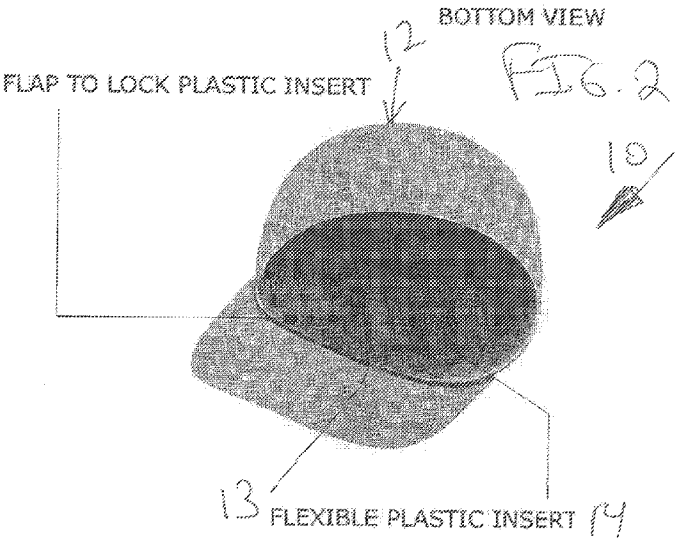
FIG. 2 is a bottom perspective view illustrating the hat insert device, constructed in accordance with the present invention, inserted within the hat.
Figure 3:
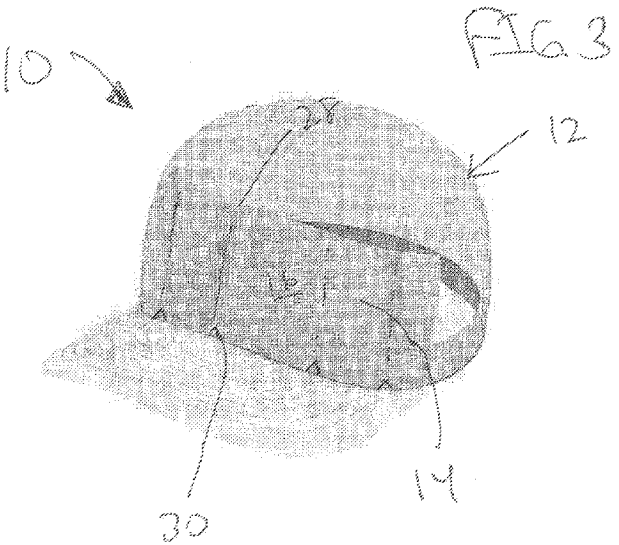
FIG. 3 is a cut-away front perspective view illustrating the hat insert device, constructed in accordance with the present invention, inserted within the hat.
Figure 4:
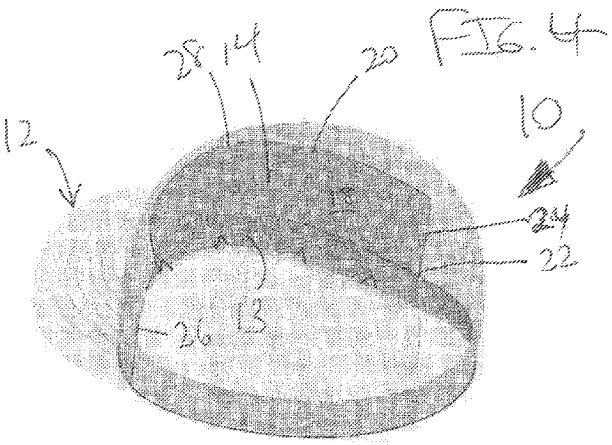
FIG. 4 is a cut-away rear perspective view illustrating the hat insert device, constructed in accordance with the present invention, inserted within the hat.

As illustrated in FIGS. 1-4, the present invention is a hat insert device, indicated generally at 10, for maintaining a hat 12 in a desired condition. The hat 12 preferably has an inner flap 13 along the opening of the hat 12 with the hat insert device 10 of the present invention providing a flexible plastic insert 14 that, when placed inside the inner flap 13 at the front of the hat 12, such as a ball cap, provides support, stiffness, and structure, keeping the hat 12 looking fresh and new.

The hat insert device 10 of the present invention is the flexible, flat, planar insert 14 having a first side 16, a second side 18 substantially opposite the first side 16, a top edge 20, a bottom edge 22 substantially opposite the top edge 20, a first edge 24 between the top edge 20 and the bottom edge 22, and a second edge 26 substantially opposite the first edge 24. The top edge 20 and the bottom edge 22 can be straight edges substantially parallel to each other or, preferably, the top edge 20 is slightly convex and the bottom edge 22 is slightly concave allowing the top edge 20 and the bottom edge 24 to better fit the form of the hat 12. Also, preferably, the first edge 24 and the second edge 26 are straight and substantially parallel to each other.

In addition, the insert 14 of the hat insert device 10 of the present invention includes first retaining means along the top edge 20 and second retaining means along the bottom edge 22. The first retaining means is preferably a first V-cut notch 28 formed in the approximate center of the top edge 20 of the insert 14. The first V-cut notch 28 preferably interacts with a seam formed on the inside of the hat 12 in the front of the hat 12 to inhibit the insert 14 from moving once positioned within the inner flap 13 of the hat 12. The second retaining means is at least one second V-cut notch 30 formed in the bottom edge 22 of the insert 14. Preferably, the second retaining means is a series of second V-cut notches 30 formed along the at least a portion or the entire length of the bottom edge 22 of the insert 14 which work to strengthen the hat insert device 10.

There are preferably four (4) second V-cut notches 30 of the insert 14 of the hat insert device 10 of the present invention which have dimensions of 0.005×0.005 rad×2⅞. The second V-cut notches 30 can be evenly spaced along the bottom edge 14 or positioned intermittingly therealong. At least one second V-cut notch 30 can be aligned with the first V-cut notch 28. The second V-cut notches 30 interact with the hat 12 within the inner flap 13 of the hat 12 to inhibit the insert 14 from moving once positioned within the inner flap 13 of the hat 12.

The insert 14 of the hat insert device 10 of the present invention is preferably constructed of a plastic material. In addition, preferably, the insert 14 has a length of approximately ten (10") inches in length, a width of approximately three and one-quarter (3¼) inches, and a thickness of approximately two-one hundredths (2/100") inch. Although the insert 14 has been described being constructed of a particular material with particular dimensions, it is within the scope of the present invention for the insert 14 to be constructed of different materials having different dimensions.

The hat insert device 10 of the present invention keeps a ball cap looking fresh, crisp, and new despite repeated wear and washings. Lightweight, sweat proof, and durable enough to last a lifetime, the hat insert device 10 lends invisible support to the peak or front of a hat 12, giving the cap structure, smoothness, and height. Over time, wear, and washing, hats, especially, ball caps lose these qualities and lose the crispness and height they had when new. The hat insert device 10 can be used to help the hat 12 maintain its shape when it is washed so that the hat 12 does not become wrinkled. The hat insert device 10 restores these qualities, making even well-worn hats look sharp and fresh, and extending the life of the cap as well. For anyone who wears or collects ball caps, the hat insert device 10 proves a minimal investment with a maximum return.

The foregoing exemplary descriptions and the illustrative preferred embodiments of the present invention have been explained in the drawings and described in detail, with varying modifications and alternative embodiments being taught. While the invention has been so shown, described and illustrated, it should be understood by those skilled in the art that equivalent changes in form and detail may be made therein without departing from the true spirit and scope of the invention, and that the scope of the present invention is to be limited only to the claims except as precluded by the prior art. Moreover, the invention as disclosed herein may be suitably practiced in the absence of the specific elements which are disclosed herein.

What is claimed is:

1. A hat insert device for maintaining a hat in a desired condition, the hat having an inner flap along an opening of the hat and a front seam formed on an inside of the hat in the front of the hat, the hat insert device comprising:

a flat, planar insert having a first side, a second side substantially opposite the first side, a top edge, a bottom edge substantially opposite the top edge, a first edge between the top edge and the bottom edge, and a second edge substantially opposite the first edge;

a first V-cut notch formed in the center of the top edge of the insert for maintaining the insert in a desired position, the first V-cut notch interacting with the front seam; and a series of second V-cut notches formed in the bottom edge of the insert for maintaining the insert in the desired position;

wherein upon positioning the insert inside the inner flap at the front of the hat, the insert provides support, stiffness, and structure to the hat.

2. The hat insert device of claim 1 wherein the top edge and the bottom edge are straight edges substantially parallel to each other.

3. The hat insert device of claim 1 wherein the top edge is convex and the bottom edge is concave.

4. The hat insert device of claim 1 wherein the first edge and the second edge are straight and substantially parallel to each other.

5. A method for maintaining a hat in a desired condition, the hat having an inner flap along an opening of the hat and a front seam formed on an inside of the hat in the front of the hat, the method comprising:

providing a flat, planar insert having a first side, a second side substantially opposite the first side, a top edge, a bottom edge substantially opposite the top edge, a first edge between the top edge and the bottom edge, and a second edge substantially opposite the first edge;

forming a first V-cut notch in the center of the top edge of the insert;

interacting the first V-cut notch with the seam;

forming a series of second V cut notches in the bottom edge of the insert;

positioning the insert inside the inner flap at a front of the hat;

maintaining the insert in a desired position; and providing support, stiffness, and structure to the hat.

6. The method of claim 5 and further comprising:

forming the top edge as convex; and forming the bottom edge as concave.

7. The hat insert device of claim 6 and further comprising:

wherein the first edge and the second edge are straight and substantially parallel to each other.

8. In combination:

a hat having an inner flap along an opening of the hat and a front seam formed on an inside of the hat in the front center of the hat;

a flat, planar insert having a first side, a second side substantially opposite the first side, a top edge, a bottom edge substantially opposite the top edge, a first edge between the top edge and the bottom edge, and a second edge substantially opposite the first edge;

a first V-cut notch formed in the center of the top edge of the insert for maintaining the insert in a desired position, the first V-cut notch interacting with the front seam; and a series of second V-cut notches formed in the bottom edge of the insert for maintaining the insert in the desired position;

wherein upon positioning the insert inside the inner flap at the front of the hat, the insert provides support, stiffness, and structure to the hat.

9. The combination of claim 8 wherein the top edge and the bottom edge are straight edges substantially parallel to each other.

10. The combination of claim 8 wherein the top edge is convex and the bottom edge is concave.

11. The combination of claim 8 wherein the first edge and the second edge are straight and substantially parallel to each other.

* * * * *